US008047924B2

(12) United States Patent
Tirelli

(10) Patent No.: US 8,047,924 B2
(45) Date of Patent: Nov. 1, 2011

(54) RIDING SIMULATION SYSTEM

(76) Inventor: Roland Tirelli, Simi Valley, CA (US)

( * ) Notice: Subject to any disclaimer, the term of this patent is extended or adjusted under 35 U.S.C. 154(b) by 142 days.

(21) Appl. No.: 12/574,367

(22) Filed: Oct. 6, 2009

(65) Prior Publication Data

US 2010/0105493 A1 Apr. 29, 2010

Related U.S. Application Data

(60) Provisional application No. 61/137,824, filed on Oct. 27, 2008.

(51) Int. Cl.
*A63G 13/06* (2006.01)
*A63G 13/00* (2006.01)

(52) U.S. Cl. ..... 472/96; 472/59; 434/247

(58) Field of Classification Search ..... 472/59–61, 472/85, 86, 92, 94–97, 99, 130; 434/55, 434/247
See application file for complete search history.

(56) References Cited

U.S. PATENT DOCUMENTS

| | | | | |
|---|---|---|---|---|
| 3,997,157 | A | 12/1976 | Meyer | |
| 4,988,300 | A | 1/1991 | Yamaguchi et al. | |
| 5,531,644 | A * | 7/1996 | Marumo | 472/68 |
| 5,584,696 | A | 12/1996 | Walker et al. | |
| 5,623,878 | A | 4/1997 | Baxter et al. | |
| 5,716,281 | A * | 2/1998 | Dote | 472/60 |
| 5,848,939 | A | 12/1998 | Smith | |
| 5,865,624 | A | 2/1999 | Hayashigawa | |
| 6,095,819 | A * | 8/2000 | Ferrand et al. | 434/247 |
| 6,124,862 | A | 9/2000 | Boyken et al. | |
| 6,210,286 | B1 | 4/2001 | Ohara et al. | |
| 6,224,491 | B1 * | 5/2001 | Hiromi et al. | 472/59 |
| 6,347,999 | B1 | 2/2002 | Yuan | |
| 7,691,002 | B2 * | 4/2010 | Casey et al. | 472/59 |
| 2006/0287137 | A1 | 12/2006 | Chu | |
| 2007/0178973 | A1 | 8/2007 | Camhi | |
| 2007/0287139 | A1 | 12/2007 | Holm | |

FOREIGN PATENT DOCUMENTS

| | | | |
|---|---|---|---|
| EP | 1510236 | A1 | 3/2005 |
| WO | WO01/89649 | A1 | 11/2001 |

* cited by examiner

*Primary Examiner* — Kien Nguyen
(74) *Attorney, Agent, or Firm* — Marc E. Hankin; Kevin Schraven; Hankin Patent Law, APC

(57) ABSTRACT

A method of providing a simulated bull ride includes guiding a rider to sit on an artificial bull in a bull chute, translating the artificial bull out of the chute along a slidably-coupled track and pivoting the artificial bull about a plurality of pivot points on an internal frame to simulate a bucking bull.

12 Claims, 3 Drawing Sheets

FIG. 1
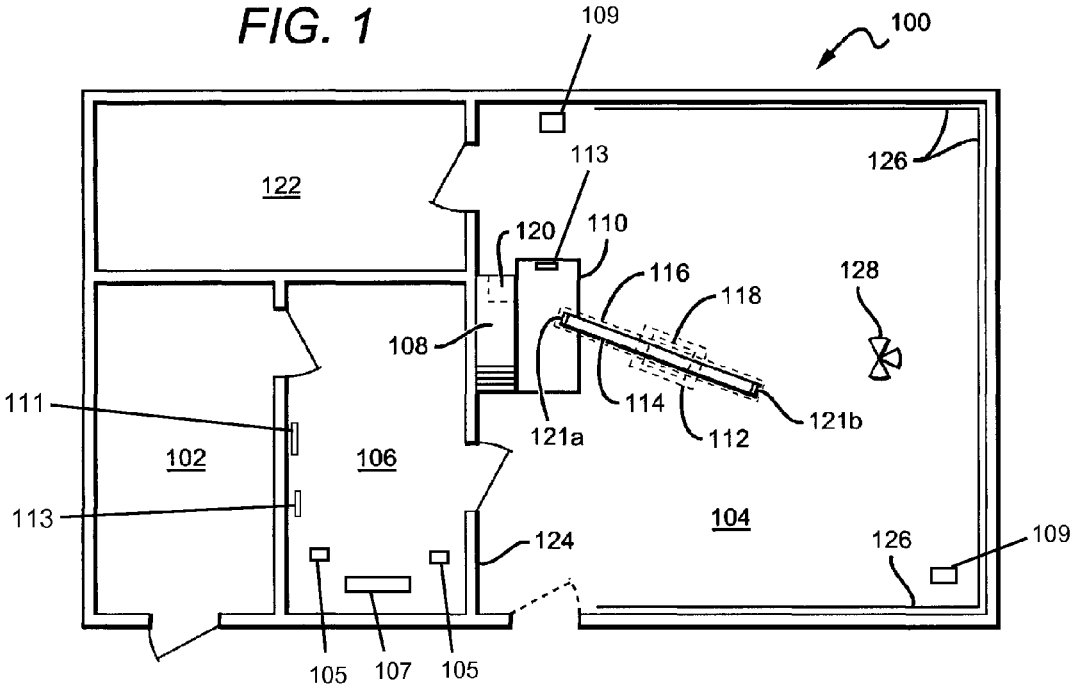
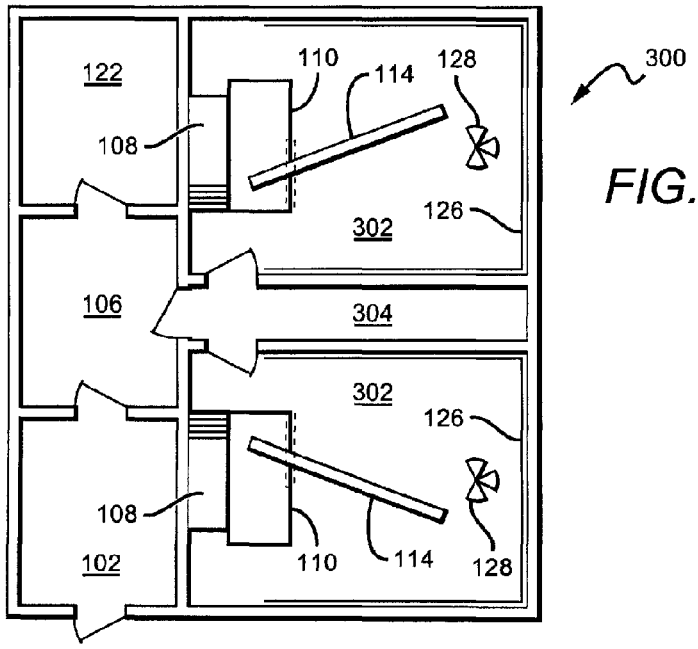
FIG. 3

FIG. 4
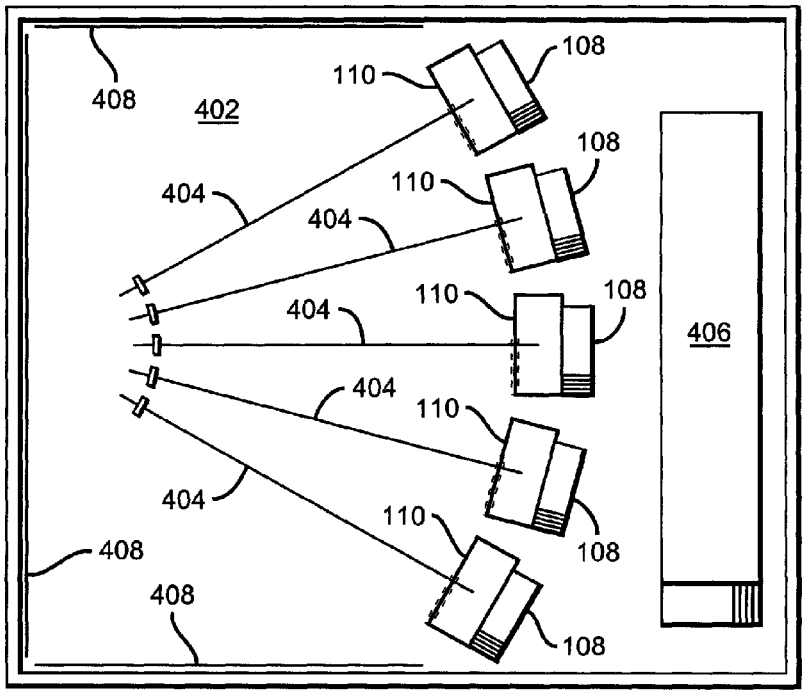
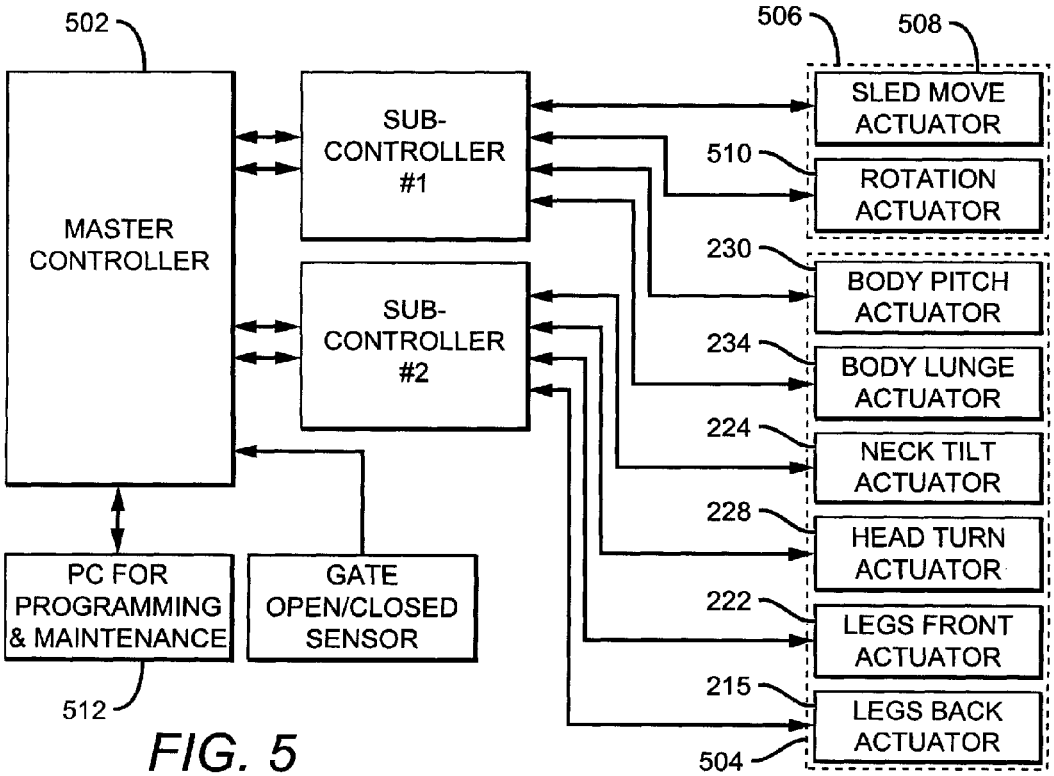
FIG. 5

RIDING SIMULATION SYSTEM

Benefit is claimed of Provisional Application Ser. No. 61/137,824 filed Oct. 27, 2008.

BACKGROUND OF THE INVENTION

1. Field of the Invention

This invention relates to ride simulation systems and more particularly to artificial animal riding systems that translate a rider along a track.

2. Description of the Related Art

Mechanical bulls have been part of American culture for decades, providing a patron of an amusement park, themed bar, or other entertainment venue with an opportunity to experience the thrill of riding a rodeo bull. Typically stationed in a fixed location, a user of a typical mechanical bull mounts a platform having a handle to hold on with, but lacking realistic movement and anatomically correct bull features such as anatomically correct head, neck, front and rear legs. After a moment's preparation, the rider of a traditional mechanical bull will hang on tightly as the riding platform spins and pitches.

Various attempts have been made to impart a greater sense of realism to such rides but have failed due, in part, to the many disciplines necessarily involved to accomplish a realistic simulation for this rare experience. For example, a display showing a virtual space may be added by hardware and software engineers in front of riding systems to provide further virtual realism. Other solutions may make use of artists to provide a portion of the riding animal within the line of sight of a user in combination with the above-mentioned display in an attempt to display the surrounding environment to impart a greater sense of realism. The ride platforms, themselves, do not replicate an authentic bull-riding experience.

Because the level of skill in the art necessary to create a bull ride, for example, is quite complex, with the number of variables available to implement such an emotional experience actually quite large, a need continues to exists to provide a realistic riding system for the enjoyment of enthusiast consumers.

SUMMARY OF THE INVENTION

A method of providing a simulated bull ride is disclosed. In one embodiment of the invention, the method is described as guiding a rider to sit on an artificial bull in a bull chute, translating the bull out of said chute along a slidably-coupled track, and pivoting said bull about a plurality of pivot points on an internal frame to simulate a bucking bull.

BRIEF DESCRIPTION OF THE DRAWINGS

The components in the figures are not necessarily to scale, emphasis instead being placed upon illustrating the principals of the invention. Like reference numerals designate corresponding parts throughout the different views.

FIG. 1 is a plan view illustrating one embodiment of an artificial animal body mounted on a sled for translation out of a bucking chute along a track into a bull-riding arena.

Figure 2:
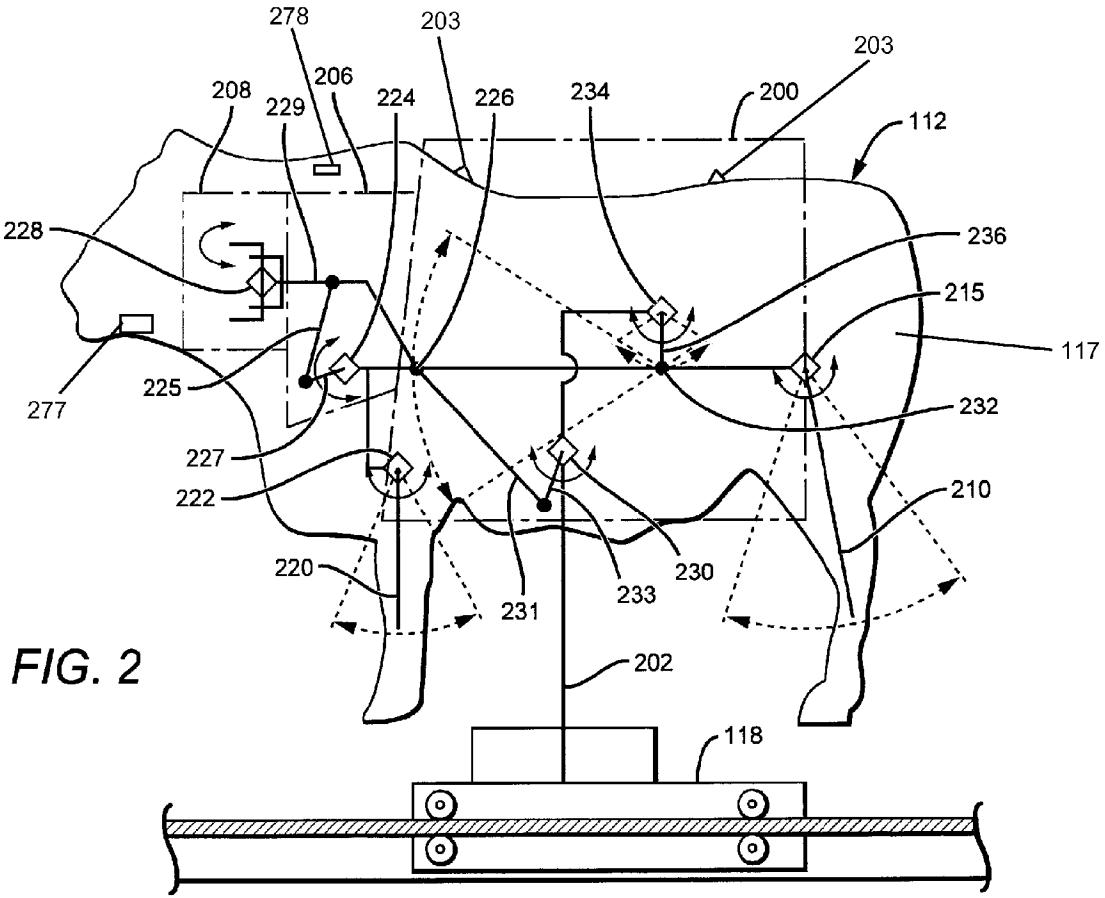

One embodiment of the invention is a method of providing a simulated animal ride, comprising the steps of: providing an artificial animal ride; providing a track; wherein the artificial animal ride is movably connected to the track; providing a ride arena that simulates an actual animal ride environment; wherein the track is within the ride arena; providing a ride chute; situating the artificial animal ride within the ride chute and at a start of the track; mounting the artificial animal ride by a rider; translating the artificial animal ride and the rider out of the chute; moving the artificial animal ride along the track; articulating the artificial animal ride at a plurality of pivot points on an internal frame of the artificial animal ride to simulate a plurality of bucking animal movements while moving the artificial animal ride along the track; stopping the artificial animal ride; and dismounting the artificial animal ride by the rider. Preferably the method is further comprised of the steps of providing a pre-ride locker room; wherein the pre-ride locker room is substantially adjacent to the ride arena; transversing the pre-ride locker room by the rider before the rider enters the ride arena; wherein the locker room simulates an actual animal ride locker room environment. The method may also comprise the steps of: preparing for the artificial animal ride by the rider within the pre-ride locker room; wherein the preparing for the artificial animal ride by the rider within the pre-ride locker room is comprised of the steps of providing a garb, wherein the garb simulates an actual animal ride dress, dressing by the rider in the garb, providing a safety gear, and equipping the rider with the safety gear. Preferably, the chute is comprised of a gate and the method preferably includes the steps of opening the gate before translating the artificial animal ride out of the chute. The method may also include the steps of: providing a catwalk; wherein the catwalk is adjacent to the chute and within the ride arena; transversing the catwalk to get to the chute by the rider; wherein the artificial animal ride has a skin, head, a neck, a body, and a plurality of legs; wherein the head, the body and the plurality of legs of the artificial animal ride substantially look like a skin, a head, a neck, a body, and a plurality of legs of an actual animal. The method may also include the steps of: providing a post; providing a sled; wherein the artificial animal ride is connected to the post, wherein the post is connected to the sled, and wherein the sled is movably connected to the track. Preferably, the plurality of pivot points on the internal frame of the artificial animal ride are comprised of: a body pitch actuator; a body lunge actuator; a neck tilt actuator; a head turn actuator; and a plurality of leg actuators. The post is preferably comprised of a post actuator. Preferably the step of articulating the artificial animal ride is comprised of the steps of: spinning of the post actuator of the post to simulate twisting of the artificial animal ride; pitching of the body pitch actuator of the artificial animal ride to simulate bucking; rotating of the body lunge actuator the artificial animal ride to simulate lunging; rotating at least one of the plurality of legs of the artificial animal ride to simulate leg movement; and pitching of the neck tilt actuator of the artificial animal ride and rotating the head turn actuator of the artificial animal ride to simulate head movement. Preferably, the ride arena is further comprised of a plurality of view screens; wherein the plurality of view screens display a plurality of scenes that simulate the actual animal ride environment. The ride arena is preferably further comprised of a plurality of projectors and a plurality of view screens; wherein the plurality of projectors display on the plurality of view screens a plurality of scenes that simulate the actual animal ride environment. Preferably the ride arena is further comprised of a plurality of speakers; wherein the plurality of speakers provides a plurality of sounds that simulate the actual animal ride environment. Preferably, the ride arena is further comprised of a plurality of artificial scent devices; wherein the plurality of artificial scent devices provide a plurality of scents that simulate the actual animal ride environment. Importantly, the scent devices and speakers may also be in the artificial animal ride itself. Typically, the safety gear is comprised of a harness and a helmet. The artificial animal ride is further comprised of one or more harness connectors; wherein the harness is comprised of one or more artificial animal ride connectors; wherein the one or more harness connectors and the one more artificial animal ride connectors are adapted to connect to each other to secure a rider to the artificial animal ride. Preferably the artificial animal ride is an artificial bull ride.

Another embodiment of the invention is a method of providing a simulated bull ride, comprising the steps of: providing an artificial bull ride; providing a track; providing a sled; wherein the artificial bull ride is connected to the post, wherein the post is connected to the sled, and wherein the sled is movably connected to the track; providing a ride arena that simulates an actual bull ride environment; wherein the ride arena is comprised of a plurality of view screens, a plurality of speakers, and a plurality of artificial scent devices; wherein the plurality of view screens displays a plurality of scenes that simulate the actual bull ride environment; wherein the plurality of speakers provides a plurality of sounds that simulate the actual bull ride environment; wherein the plurality of artificial scent devices provide a plurality of scents that simulate the actual bull ride environment; wherein the track is within the ride arena; providing a ride chute; wherein the chute is comprised of a gate; situating the artificial bull ride within the ride chute at a start of the track; providing a catwalk; wherein the catwalk is adjacent to the chute and within the ride arena; providing a pre-ride locker room; wherein the locker room simulates an actual bull ride locker room environment; entering the pre-ride locker room by the rider before the rider enters the ride arena; preparing for the artificial bull ride by the rider within the pre-ride locker room; providing a garb, wherein the garb simulates an actual bull ride dress; dressing by the rider in the garb; providing a safety gear; equipping the rider with the safety gear; wherein the pre-ride locker room is substantially adjacent to the ride arena; entering the ride arena by a rider; transversing the catwalk to get to the chute by the rider; mounting the artificial bull ride by a rider; opening the gate; translating the artificial bull ride out of the chute; moving the artificial bull ride along the track; articulating the artificial bull ride at a plurality of pivot points on an internal frame of the artificial bull ride to simulate a plurality of bucking bull movements; stopping the artificial bull ride; dismounting by the rider the artificial bull ride. Preferably, the artificial bull ride has a skin, head, a neck, a body, and a plurality of legs; wherein the head, the body and the plurality of legs of the artificial bull ride substantially look like a skin, a head, a neck, a body, and a plurality of legs of an actual bull; wherein the plurality of pivot points on the internal frame of the artificial bull ride are comprised of: a body pitch actuator; a body lunge actuator; a neck tilt actuator; a head turn actuator; and a plurality of leg actuators; and wherein the post is comprised of a post actuator. Preferably, the articulating the artificial bull ride is comprised of the steps of: spinning of the post actuator of the post to simulate twisting of the artificial bull ride; pitching of the body pitch actuator of the artificial bull ride to simulate bucking; rotating of the body lunge actuator the artificial bull ride to simulate lunging; rotating at least one of the plurality of legs of the artificial bull ride to simulate leg movement; and pitching of the neck tilt actuator of the artificial bull ride and rotating the head turn actuator of the artificial bull ride to simulate head movement. Importantly, the scent devices and speakers may also be in the artificial animal ride itself in addition to being in the ride arena.

FIG. 2 illustrates one embodiment of a main body frame for an artificial animal body mounted on a sled, the main body frame provided with actuators for providing bucking and appendage movements for the riding system.

FIG. 3 is a plan view of one embodiment of a riding system illustrating two adjacent animal riding arenas.

FIG. 4 is one embodiment of a riding arena having more than one artificial animal body and track combination in the same riding arena.

FIG. 5 is a block diagram of a control system having a master controller for controlling translational, bucking and appendage movements for the riding system.

DETAILED DESCRIPTION OF THE INVENTION

An unusually realistic riding system is described for providing a user with a virtual reality simulation ride of an animatronic artificial animal body without compare. In a preferred embodiment of the artificial animal body, a rodeo bull has a main body frame, head and legs that operate together while the rodeo bull is translated out of a bucking shoot and into a bull riding arena along a track to provide a convincing and risk-free bull riding experience. A pre-show locker room may also be provided to receive a human rider for instruction on the riding system prior to mounting the rodeo bull.

FIG. 1 illustrates one embodiment of a riding system that has a single artificial animal body mounted along a track in a riding arena to recreate the thrill of the animal rider's experience while using only an inventive few of the many possible elements available for such a re-creation. In a preferred embodiment, the riding system is a rodeo bull riding system 100 that has an entry room 102 to receive a bull rider for ticket sales. Alternatively, the entry room 102 may be a riding system staging area, ticket reception or other room for riders preparatory to entering the remainder of the riding system 100. The bull rider preferably enters the bull-riding arena 104 through a pre-show locker room 106 positioned adjacent to and allowing bull rider entry into the bull-riding arena 104. The pre-show room 106 provides entertainment features to establish the appropriate entertainment atmosphere. In the preferred embodiment, the pre-show room 106 is configured as a locker room with bull riding equipment. Lockers may be provided on any of the interior walks for riders to store loose items and valuables prior entering the bull-riding arena 104. Speakers 105 are preferably positioned to direct rodeo sounds into the pre-show locker room 106. A television monitor 107 preferably loops safety instructions. FIG. 1 also shows that locker room 106 has lockers or shelves that contain garb 111 and safety equipment 113. Garb 111 may include cowboy hats, boots, chaps, and other rodeo appropriate clothing. Safety equipment 113 preferably includes helmets and protective guest restraint systems, such as padded harnesses. The padded harnesses are preferably a wearable vest with artificial animal ride connectors. The artificial animal ride connectors are preferably connected to harness connectors (shown in FIG. 2), to secure the rider to the artificial animal ride. The arena 104, pre-show locker room 106, entry room 102, and post-show gift shop 122 may be adapted to be portable so that the bull ride can travel to various venues, including carnivals.

The bull-riding arena 104 has a catwalk 108 accessible by a short staircase, positioned along one wall and raised off the floor of the arena to help a bull rider mount a rodeo bull 112 that is positioned in a bucking chute 110. The rodeo bull 112 is connected to a track 114 through a false floor 116 to allow translational movement out of the bucking chute 110 and into a center portion of the arena 104. Although the track course is illustrated as linear, a non-linear track course may be used to simulate movement of the bull 112 about the bull-riding arena. Preferably, the rodeo bull 112 is connected to the track 114 through a wheeled sled 118 that may house a cabling return (not shown) to facilitate take-up and reeling of signal cabling as the rodeo bull 112 is operable to spun through up to 360 degrees of rotation in either rotational direction. Signal cabling is connected to a computer control 120 optionally located underneath the raised platform 108. In alternate embodiments, the computer control 120, which is programmed to operate the actuators to provide a smooth, safe, and fun bull ride experience, is located in a portable cabinet that may be located anywhere inside or outside of the arena 104. Over-travel sensors 121*a* and 121*b* are located on either end of the track 114 to provide an emergency over-travel stop signal to the computer control 120 should the rodeo bull 112 fail to stop at its predetermined stop location. A post-show gift shop 122 may be located adjacent the bull-riding arena 104 to receive the riders as they exit the bull-riding arena 104. In one alternative embodiment, a grandstand is provided preferably between the raised platform 108 and an interior wall 124 of the bull-riding arena 104 to allow patrons to watch the rider and artificial bull 112 as they are translated along the track 114 out of the bucking chute 110 and into the center of the bull-riding arena 104. A surround screen 126 is positioned along an exterior portion of the bull-riding arena 104, preferably along interior three sides of the bull-riding arena 104. Although illustrated as flat in FIG. 1, in an alternative embodiment, the surround screen may be semicircular or extend along only one or two interior wall portions of the bull-riding arena 104. Projector 128 may be positioned on the ceiling of the bull-riding arena 104 or may be positioned on an upper side wall of the bull-riding arena 104 to project a visual scene of a crowd, preferably without displaying any portion of an associated gating or bull arena to allow for real-time placement of sponsorship signage about bull-riding arena 104. Speakers 109 may also be configured within the arena to provide audible sounds of a typical bull arena. FIG. 1 also shows how the arena 104 includes artificial scent devices 113. The artificial scent devices 113 help further simulate the actual bull or other animal ride environment. View or surround screens 126 may be flat screen monitors or they may be screens upon which an image may be projected by projector 128. Additionally, the view screen 126 may be a surround screen that is curved and substantially surrounds the arena 104. Typically projector 128 is a plurality of projectors, one for each screen or portion of a screen.

During operation, a rider enters the pre-show locker room 106 after receiving a ticket in the entry room 102. A monitor in the pre-show locker room 106 projects a video of a cowboy announcer welcoming the patrons to the bull-riding system, and explaining various items such as safety rules. Each rider is given an arm band by a cowboy attendant, who also explains how the vest, chaps, helmet, and other equipment are used and worn. After completing the instruction, the rider is escorted from the pre-show locker room 106 onto the catwalk 108 to mount the bull 112.

FIG. 2 illustrates the various frame components and actuators for a main body frame of an artificial animal body, in a preferred embodiment a rodeo bull, which is mounted on a sled for translation along a track. A main body frame, illustrated in one embodiment as those components encompassed by dashed line 200, is mounted on a post 202 rotatably connected to a sled 118. A head portion, illustrated in one embodiment as those components encompassed by dashed line 208, is connected to the main body frame 200 through a neck assembly 206, with the neck assembly defined as having those components encompassed by dashed line 206. Rear leg portion 210 is connected to the main body frame 200 through rear-leg actuator 215. Rear-leg actuator 215 is operable to drive the rear-leg armature 210 to accomplish walking, running and kicking motions for the artificial animal body through angular rotation. For example, rapid counterclockwise rotation of rear-leg actuator 215 would result in a rear leg kick action. Slower actuation may be used to simulate walking. A front-leg armature 220 is connected to the main body frame 200 through front-leg actuator 222 to provide movement. Similar to that provided for rear leg armature 210, front-leg actuator 222 is operable to drive the front-leg armature 220 in either a clockwise or counterclockwise rotational direction to simulate walking, running and kicking. Although rear-leg armature 210 and front-leg armature 220 are each illustrated as one leg and described in the singular, each leg armature (210, 200) provides two artificial animal legs, as would be found in an anatomically correct and whole animal.

The neck assembly 206 is provided with movement by neck actuator 224 that drives neck actuators 225, 227 to provide pitch up and pitch down of the neck assembly 206 about neck pivot point 226. For example, clockwise actuation of armature 227 would drive neck actuator 225 up, result in a pitching up of the neck assembly 206. Similarly, counterclockwise actuation of armature 227 would result in a pitching down of the neck assembly 206. Head actuator 228 drives a left and right turning motion to the head portion 208 about a single axis of rotation and is coupled to the neck assembly with a rigid rod 229 so that pitching of the neck assembly 206 results in a concurrent pitching of the head portion 208 while the head actuator 228 allows independent left and right movement of the head portion 208.

An unusual and new technique is provided with the use of body pitch actuator 230 to drive pitch armatures 231, 233 resulting in a rotational moment about main body rotation point 232. As illustrated, clockwise rotation of the body pitch actuator 230 results in a pitching up or bucking of an artificial animal body positioned as illustrated in FIG. 2. Counter clockwise rotation of the body pitch actuator armature 230 would result in a pitching down rotation about the main body rotation point 232. An unusual and new technique is also provided with main body actuator 234 that may rotate lunge armature 236 in a clockwise rotation to produce a forward translation or lunging movement of the rodeo bull 112. A counterclockwise rotation of lunge armature 236 would result in a rear translation of the rodeo bull 112. These previously unknown apparatus and methods for pitching and lunging result from coordinated actuation of actuators 235 and 230, respectively, to create the synergistic and previously-unpredictable result (to a typical mechanic) of reproducing the bucking and lunging movements of a rodeo bull movement when the main body frame 200 is provided with a rodeo bull 112 exterior. FIG. 2 also shows how the bull 112 has a skin 117 that simulates the look and feel of a real bull. Although a bull is the preferred mechanical or animatronics animal, it should be understood that any animal shape may be used, such as a horse, buffalo, or camel, without deviating from the scope of the invention. Further, to make the bull 112 even more realistic and to better simulate a bull ride environment, the bull 112 may have speakers 277 and artificial scent devices 278. The speakers 277 would typically be used to provide bull sounds, such as roars, grunts, or heavy breathing. The artificial scent devices 278 could provide the aroma of a bull getting ready to buck. In other embodiments of the invention the skin 117 may be moved by devices under the skin 117 that simulate the breathing of the bull as it exerts itself during a bull ride. FIG. 2 also shows how the bull 112 preferably includes harness connectors 203, which connect to a harness worn by a user to keep the user securely mounted on bull 112. The harness connectors 203 and harness may connect to each other through any connection device, clip, or other fastener.

FIG. 3 illustrates one embodiment of a riding system 300 that has two adjacent bull riding arenas that share an entry room and pre-show locker room. In one implementation, each bull in riding arena 302 has the catwalk 108 behind a perspective bucking chute 110. The artificial bull (not shown) is slidably coupled to the track 114 extending from within the bucking chute 110 to a center section of bull arena 302. The pre-show locking room 106 is configured adjacent to the bull riding arenas 302 and between the entry room 102 and post-show gift shop 122. Although the post-show gift shop 122 and entry room 102 are illustrated on opposing sides of the pre-show locker room 106, the post-show gift shop 122 may be located on a side of the bull arenas 302 opposite from the pre-show locker room 102 or in a predetermined location advantageous for the desired overall exterior shape of the riding system 300. Similarly, the entry room 102 may be positioned serially with the pre-show locker room 106 and bull arenas 302 to produce a generally rectangular exterior riding system 300 dimensions. As illustrated, a hallway 304 is configured between the bull arenas 302 to receive riders from the pre-show locker room 106 prior to their direction into respective catwalks 108 in each respective bull arena 302. Each bull-riding arena 302 has a surround screen 126 positioned along respective exterior portions of its bull riding 302, preferably along interior three sides of each bull-riding arena 302. As in other embodiments of the bull-riding arena 302, the surround screen may be semicircular or extend along only one or two interior wall portions of the arena 302. The projector 128 may be positioned on the ceiling of the bull-riding arena 302 or may be positioned on an upper side wall or rear area of bull-riding arena 302 to project a visual scene of a crowd.

FIG. 4 illustrates a five-track configuration for use in a single bull arena 402. Each respective track 404, bucking chute 110, catwalk 108 and artificial bull (not shown) combination is generally spaced and splayed out in a radial formation about a central axis of the bull riding arena 402. Although illustrated as following a linear course, any or all of the tracks 404 may follow a non-linear course. Preferably, a grandstand 406 sits adjacent and immediately behind the plurality of catwalks 108 to allow patrons to view the bull arena 402. In this embodiment, a surround screen 408 is preferably defined by three flat screens on contiguous three walls facing the grandstand 406 to receive imagery or video of a bull arena crowd (not shown). In an alternative embodiment, the three flat screens may be replaced with a generally curved screen or with a single screen facing the grandstand 406.

FIG. 5 illustrates a block diagram of the control system for controlling the riding system illustrated in FIG. 1. A master controller 502 is in electrical communication with both the rodeo bull 504 and sled 506 through subcontroller 2 and subcontroller 1, respectively. Body pitch actuator 230 and body lunge actuator 234 are in electrical communication with master controller 502 through subcontroller 1 to actuate the synergistic technique resulting from vertical pitch and horizontal lunge commands, respectively. Head turn actuator 228 and neck tilt actuator 224 are in electrical communication with the master controller 502 through subcontroller 2 to provide turning of the head movement and tilting of the neck movement, respectively. Also in electrical communication with the master controller 502 are the front leg actuator 222 and rear-leg actuator 215 to provide rotational movement for the front and back legs, respectively. Sled move actuator 508 and artificial animal body rotation actuator 510 are in communication with the master controller 502 through subcontroller 1 to provide translational movement for the sled and rotational movement for the artificial animal body, respectively. A personal computer 512 is in communication with the master controller to provide specific instructions for predetermined actuation and maintenance of the various rodeo bull 504 and sled 506 actuators to provide for a riding system with synergistic results While various implementations of the application have been described, it will be apparent to those of ordinary skill in the art that many more embodiments and implementations are possible that are within the scope of this invention.

I claim:

1. A method of providing a simulated animal ride, comprising the steps of:

providing an artificial animal ride;

providing a track;

wherein said artificial animal ride is movably connected to said track;

providing a ride arena that simulates an actual animal ride environment;

wherein said track is within said ride arena;

providing a ride chute;

situating said artificial animal ride within said ride chute and at a start of said track;

mounting said artificial animal ride by a rider;

translating said artificial animal ride and said rider out of said chute;

moving said artificial animal ride along said track;

articulating said artificial animal ride at a plurality of pivot points on an internal frame of said artificial animal ride to simulate a plurality of bucking animal movements while moving said artificial animal ride along said track;

stopping said artificial animal ride;

dismounting said artificial animal ride by said rider;

providing a pre-ride locker room;

wherein said pre-ride locker room is substantially adjacent to said ride arena;

transversing said pre-ride locker room by said rider before said rider enters said ride arena;

wherein said locker room simulates an actual animal ride locker room environment;

preparing for said artificial animal ride by said rider within said pre-ride locker room;

wherein said preparing for said artificial animal ride by said rider within said pre-ride locker room is comprised of the steps of: providing a garb; wherein said garb simulates an actual animal ride dress; dressing by said rider in said garb; providing a safety gear; equipping said rider with said safety gear;

wherein said chute is comprised of a gate;

opening gate before translating said artificial animal ride out of said chute;

providing a catwalk;

wherein said catwalk is adjacent to said chute and within said ride arena;

transversing said catwalk to get to said chute by said rider;

wherein said artificial animal ride has a skin, a head, a neck, a body, and a plurality of legs;

wherein said head, said body and said plurality of legs of said artificial animal ride substantially look like a skin, a head, a neck, a body, and a plurality of legs of an actual animal;

providing a post; and providing a sled;

wherein said artificial animal ride is connected to said post, wherein said post is connected to said sled, and wherein said sled is movably connected to said track.

2. The method of providing a simulated animal ride of claim 1, wherein said plurality of pivot points on said internal frame of said artificial animal ride are comprised of:

a body pitch actuator;

a body lunge actuator;

a neck tilt actuator;

a head turn actuator; and a plurality of leg actuators;

wherein said post is comprised of a post actuator.

3. The method of providing a simulated animal ride of claim 2, wherein said articulating said artificial animal ride is comprised of the steps of:

spinning of said post actuator of said post to simulate twisting of said artificial animal ride;

pitching of said body pitch actuator of said artificial animal ride to simulate bucking;

rotating of said body lunge actuator said artificial animal ride to simulate lunging;

rotating at least one of said plurality of legs of said artificial animal ride to simulate leg movement; and pitching of said neck tilt actuator of said artificial animal ride and rotating said head turn actuator of said artificial animal ride to simulate head movement.

4. The method of providing a simulated animal ride of claim 3, wherein said ride arena is further comprised of a plurality of view screens;

wherein said plurality of view screens display a plurality of scenes that simulate said actual animal ride environment.

5. The method of providing a simulated animal ride of claim 3, wherein said ride arena is further comprised of a plurality of projectors and a plurality of view screens;

wherein said plurality of projectors display on said plurality of view screens a plurality of scenes that simulate said actual animal ride environment.

6. The method of providing a simulated animal ride of claim 3, wherein said ride arena is further comprised of a plurality of speakers;

wherein said plurality of speakers provides a plurality of sounds that simulate said actual animal ride environment.

7. The method of providing a simulated animal ride of claim 3, wherein said ride arena is further comprised of a plurality of artificial scent devices;

wherein said plurality of artificial scent devices provide a plurality of scents that simulate said actual animal ride environment.

8. The method of providing a simulated animal ride of claim 3, wherein said artificial animal ride is further comprised of one or more harness connectors;

wherein said harness is comprised of one or more artificial animal ride connectors;

wherein said one or more harness connectors and said one more artificial animal ride connectors are adapted to connect to each other to secure a rider to said artificial animal ride.

9. A method of providing a simulated animal ride of claim 3, wherein said artificial animal ride is an artificial bull ride.

10. A method of providing a simulated bull ride, comprising the steps of:

providing an artificial bull ride;

providing a track;

providing a sled;

wherein said artificial bull ride is connected to said post, wherein said post is connected to said sled, and wherein said sled is movably connected to said track;

providing a ride arena that simulates an actual bull ride environment;

wherein said ride arena is comprised of a plurality of view screens, a plurality of speakers, and a plurality of artificial scent devices;

wherein said plurality of view screens displays a plurality of scenes that simulate said actual bull ride environment;

wherein said plurality of speakers provides a plurality of sounds that simulate said actual bull ride environment;

wherein said plurality of artificial scent devices provide a plurality of scents that simulate said actual bull ride environment;

wherein said track is within said ride arena;

providing a ride chute;

wherein said chute is comprised of a gate;

situating said artificial bull ride within said ride chute at a start of said track;

providing a catwalk;

wherein said catwalk is adjacent to said chute and within said ride arena;

providing a pre-ride locker room;

wherein said locker room simulates an actual bull ride locker room environment;

entering said pre-ride locker room by said rider before said rider enters said ride arena;

preparing for said artificial bull ride by said rider within said pre-ride locker room;

providing a garb, wherein said garb simulates an actual bull ride dress;

dressing by said rider in said garb;

providing a safety gear;

equipping said rider with said safety gear;

wherein said pre-ride locker room is substantially adjacent to said ride arena;

entering said ride arena by a rider;

transversing said catwalk to get to said chute by said rider;

mounting said artificial bull ride by a rider;

opening said gate;

translating said artificial bull ride out of said chute;

moving said artificial bull ride along said track;

articulating said artificial bull ride at a plurality of pivot points on an internal frame of said artificial bull ride to simulate a plurality of bucking bull movements;

stopping said artificial bull ride;

dismounting by said rider said artificial bull ride.

11. The method of providing a simulated bull ride of claim 10, wherein said artificial bull ride has a skin, head, a neck, a body, and a plurality of legs;

wherein said head, said body and said plurality of legs of said artificial bull ride substantially look like a skin, a head, a neck, a body, and a plurality of legs of an actual bull;

wherein said plurality of pivot points on said internal frame of said artificial bull ride are comprised of: a body pitch actuator; a body lunge actuator; a neck tilt actuator; a head turn actuator; and a plurality of leg actuators;

wherein said post is comprised of a post actuator.

12. The method of providing a simulated bull ride of claim 11, wherein said articulating said artificial bull ride is comprised of the steps of:

spinning of said post actuator of said post to simulate twisting of said artificial bull ride;

pitching of said body pitch actuator of said artificial bull ride to simulate bucking;

rotating of said body lunge actuator said artificial bull ride to simulate lunging;

rotating at least one of said plurality of legs of said artificial bull ride to simulate leg movement; and pitching of said neck tilt actuator of said artificial bull ride and rotating said head turn actuator of said artificial bull ride to simulate head movement.

* * * * *